US008092649B2

(12) United States Patent
Shevchenko et al.

(10) Patent No.: US 8,092,649 B2
(45) Date of Patent: Jan. 10, 2012

(54) METHOD OF DECREASING THE RATE OF PHOTOYELLOWING WITH THIOCYANIC ACID

(75) Inventors: Sergey M. Shevchenko, Aurora, IL (US); Prasad Y. Duggirala, Naperville, IL (US)

(73) Assignee: Nalco Company, Naperville, IL (US)

( * ) Notice: Subject to any disclaimer, the term of this patent is extended or adjusted under 35 U.S.C. 154(b) by 287 days.

(21) Appl. No.: 11/302,862

(22) Filed: Dec. 14, 2005

(65) Prior Publication Data

US 2007/0131373 A1 Jun. 14, 2007

(51) Int. Cl.
*D21H 17/62* (2006.01)
*D21H 21/38* (2006.01)
*D21H 17/11* (2006.01)

(52) U.S. Cl. ..... 162/160; 162/127

(58) Field of Classification Search ..... 162/60, 162/160, 72, 127

See application file for complete search history.

(56) References Cited

U.S. PATENT DOCUMENTS

| | | | | |
|---|---|---|---|---|
| 3,773,464 | A | 11/1973 | Streck | |
| 4,395,115 | A | 7/1983 | Tsuda et al. | |
| 4,636,819 | A | 1/1987 | Nagamoto et al. | |
| 6,302,999 | B1 * | 10/2001 | Engelhardt et al. | 162/135 |
| 6,500,303 | B1 * | 12/2002 | Seltzer et al. | 162/158 |
| 2003/0094120 | A1 * | 5/2003 | Golley et al. | 106/486 |
| 2004/0149410 | A1 * | 8/2004 | Rohringer et al. | 162/162 |
| 2007/0187650 | A1 * | 8/2007 | Anders et al. | 252/397 |

FOREIGN PATENT DOCUMENTS

| | | | |
|---|---|---|---|
| WO | 96/11193 | | 4/1996 |
| WO | WO 2005030906 | A2 * | 4/2005 |
| WO | 2007/057369 | A1 | 5/2007 |

OTHER PUBLICATIONS

Moura et al., The Effect of Additives on the Photostability of Dyed Polymers, 1997, Dyes and Pigments, whole document.*

Pan et al., Brightness Reversion of Mechanical Pulps Part VI, Mar. 1995, IPST Technical Paper Series, whole doc.*

Ragauskas et al., Brightness Reversion of Mechanical Pulps XIV, Aug. 1998, IPST technical Paper Series, whole doc.*

Pan et al., Controlling Darkening Reactions during Mechanical Pulping with Additives, Apr. 2004, J. of Tianjin University of Science and Technology, vol. 19, whole document.*

Dolenc, Are quinone methides responsible for yellowing of paper in light?, 2002, Tetrahedron Letters, 43, p. 5669-5671.*

Malesic et al., The influence of halide and psuedo-halide antioxidants in Fenton-like reaction systems containing copper(II) ions, Aug. 2005, Journal of Molecular catalysts, whole document.*

Streitwieser, Driving force and nucleophilicity in SN2 displacements, 1985, Proc. Natl. Acad. Sci, vol. 82. whole document.*

Agnemo, Studies on the Mechanism of the Photpyellowing of Bleached Mechanical and Chemimechanical Pulps, 1991, Holzforschung, 45, p. 101-108.*

Kolar, J.; Strlic, M. Stabilization of alkaline cellulose with halides and pseudo-halides. Proceedings of the International Conference "Chemical Technology of Wood, Pulp and Paper", Ed. G.Baudin, Bratislava, Slovakia, Sep. 17-19, 2003, 422-423.

Moura et al., The Effect of Additives on the Photostability of Dyed Polymers, 1997, Dyes and Pigments.

* cited by examiner

*Primary Examiner* — Matthew Daniels
*Assistant Examiner* — Anthony Calandra
(74) *Attorney, Agent, or Firm* — Benjamin E. Carlsen; Michael B. Martin

(57) ABSTRACT

A method of decreasing the rate of photoyellowing in paper containing mechanical pulp comprising: applying an aqueous solution containing an effective amount of one or more salts of thiocyanic acid on the surface of a paper sheet in a papermaking process.

19 Claims, No Drawings

METHOD OF DECREASING THE RATE OF PHOTOYELLOWING WITH THIOCYANIC ACID

FIELD OF THE INVENTION

This disclosure pertains to methods of decreasing the rate of photoyellowing of paper produced from mechanical pulp.

BACKGROUND OF THE INVENTION

Mechanical pulps can be used in furnishes for the manufacture of business forms, writing papers, and high grade publication papers for books, which are all long-life uses requiring paper that does not yellow with age. Mechanical pulps include groundwood (GW), refiner mechanical pulp (RMP), thermomechanical pulp (TMP), chemithermomechanical pulp (CTMP), chemimechanical pulp (CMP), variations thereof (e.g., stone GW, pressurized GW, thermo-RMP, pressure RMP, pressure TMP, chemi-RMP, long fiber CMP, thermomechanical chemi pulp); recycled pulp; and compositions containing mechanical, chemical and recycled pulps.

Papers, however, made with mechanical pulps are known to turn yellow during use. This yellowing restricts their use to applications requiring only a short-life for the paper. If the time taken before yellowing of these papers begins could be increased, the potential market for bleached TMP and CTMP would be expanded significantly, for example, more bleached TMP and CTMP could be included in mixed (e.g., kraft-mechanical or sulfite-mechanical) furnishes used to manufacture high brightness papers. Displacing significant amounts of more expensive fully bleached, low yield chemical pulps with less expensive high yield mechanical pulps promises significant economical benefits.

Photoyellowing occurs primarily in finished paper. It is thought that photoyellowing results mainly from radical photochemical reactions of residual lignin in pulp. Therefore, high-lignin pulps and products containing such pulps are more susceptible to brightness loss than more expensive, low-lignin pulps. Phenoxyl, hydroxyl, alkoxyl and peroxyl radicals are likely intermediates in the process. Consequently, radical scavengers and hydrogen donors/antioxidants provide protection against photoyellowing. Photoexcitation of α-carbonyl groups often triggers a chain of radical reactions, and chemical modification of such groups as well as absorption of light energy by optical (UV) screens/absorbers affect discoloration significantly. The known classes of chemicals that provide limited protection against photoyellowing of mechanical pulps include thiols, stable nitroxide radicals, sterically hindered hydroxylamines, phosphites, dienes, aliphatic aldehydes, and UV screens. Usually, the amounts of chemicals required for adequate protection are not economically feasible and these compounds usually carry other undesirable traits, such as high toxicity and unpleasant odors. A need therefore exists for a method of decreasing the rate of photoyellowing that is non-toxic and economical.

SUMMARY OF THE INVENTION

The present invention provides for a method of decreasing the rate of photoyellowing in paper containing mechanical pulp comprising: applying an aqueous solution containing an effective amount of one or more salts of thiocyanic acid on a paper sheet in a papermaking process.

DETAILED DESCRIPTION OF THE INVENTION

"Papermaking process" means a method of making paper products from pulp comprising forming an aqueous cellulosic papermaking furnish, draining the furnish to form a sheet and drying the sheet. The steps of forming the papermaking furnish, draining, and drying may be carried out in any conventional manner generally known to those skilled in the art.

A "wet paper sheet" refers to a paper sheet that has not been exposed to a drum dryer in a papermaking process.

A "dry paper sheet" refers to a paper sheet that has been exposed to a drum dryer in a papermaking process.

"o.d." means over dry.

"EDTA" means ethylendiaminetetraacetic acid.

"DTPA" means diethylenetriaminepentaacetic acid.

"DTMPA" means diethylenetriaminepentakis(methylphosphonic acid).

As mentioned above, the present invention provides for applying an aqueous solution containing an effective amount of one or more salts of thiocyanic acid on the surface of a paper sheet in a papermaking process. In one embodiment of the invention, the effective amount of salts is 0.01 to 5 wt % of oven dried pulp based upon 40% active solids; preferably 0.05 to 1.0 wt % of oven dried pulp based upon 40% active solids. For purposes of this application the definition of the term "active solids" is the non-water portion of the pulp.

In another embodiment, the pH range of the aqueous solution may be from 3 to 9; preferably from 6 to 7.

In another embodiment, the salts of thiocyanic acid are selected from the group consisting of: inorganic thiocyanates; sodium thiocyanate; potassium thiocyanate; ammonium thiocyanate; and calcium thiocyanate.

In another embodiment, the cation of said salts is selected from the group consisting of: organic cations; and inorganic cations.

In another embodiment, an effective amount of one or more chemicals, which are selected from the group consisting of chelants; optical brighteners; fluorescent dyes; UV absorbers; and a combination thereof, may be added either separately or as a mixture with an aqueous solution containing an effective amount of one or more salts of thiocyanic acid. In a further embodiment, an effective amount of chemicals is 0.01 to 5 wt % of oven dried pulp based upon a 40% active solids; preferably 0.05 to 1.0 wt % of oven dried pulp based upon 40% of active solids.

In another embodiment, the UV absorbers are selected from the group consisting of: benzotriazoles; benzophenones; inorganic oxides; organic particulates; and latex particulates. To those of ordinary skill in the art, the term UV absorbers are synonymous with the term UV screens.

In another embodiment, the chelants are selected from the group consisting of: EDTA; DTPA; and DTMPA.

In another embodiment, optical brighteners are selected from the group consisting of: substituted stilbenedi, tetra- and hexasulfonic acids; triazynilaminostilbene acids; dicyano-1, 4-bis-styrylbenzenes, bisbenzoxazoles, bis(triazynilamino) stilbenes; sulfonated fused polyaromatic (polynuclear) compounds; and distilbenes.

In another embodiment, an aqueous solution containing an effective amount of one or more salts of thiocyanic acid is mixed with a chelant in a ratio from 1:100 to 100:1 on the base of active solids.

In another embodiment, the aqueous solution containing an effective amount of one or more salts of thiocyanic acid is mixed with a UV absorber in a ratio 1:100 to 100:1 on the base of active solids.

In another embodiment, the aqueous solution is around 10% to around 60% aqueous solution of an active material comprising sodium thiocyanate or ammonium thiocyanate or a mixture of said sodium thiocyanate or said ammonium thiocyanate with a chelant selected from the group consisting of: DTPA; EDTA; and DTMPA in a ratio from around 1:100 to around 100:1.

The aqueous solution may be applied to a wet paper sheet or a dry paper sheet by using any known technique in the art of papermaking. For example, the application of an aqueous solution to a wet paper sheet may be applied through a spray nozzle that is proximate to a desired area of the wet paper sheet.

In another embodiment, the aqueous solution is applied to a paper sheet by applying said aqueous solution to the surface of a partly dewatered sheet in a papermaking process before it hits a first drum dryer. In yet a further embodiment, the aqueous solution is applied to a paper sheet by applying said aqueous solution in or after the press section of said papermaking process.

In another embodiment, the aqueous solution is applied to a paper sheet by applying said aqueous solution to a sizing solution at a surface sizing stage of a papermaking process.

After applying the chemical(s) by one of the above-mentioned methodologies, the test sheets were dried in a drum drier (1 cycle, 100° C.) and equilibrated at constant humidity 50% and 23° C. The brightness was measured and then the sheets were exposed to "cool white" light on a rotating carousel at room temperature. An LZC-1 Photoreactor (LuzChem Research, St. Sauveur, QC, Canada) was used in the experiments. The samples were again equilibrated and brightness measured (R457 brightness, E313 yellowness, Elrepho-3000 instrument, Datacolor International, Charlotte, N.C.).

The doses in the following tables were calculated based on weight % of o.d. pulp and a product containing 40% active thiocyanates. For the interpretation of these tables, the following legend should be utilized: Br0—initial brightness, Ye0—initial yellowness, Br1—brightness after exposure, Ye1—yellowness after exposure, brightness loss BrLoss=Br0−Br1, inhibition %Inh=100*[BrLoss(control)−BrLoss(sample)]/BrLoss(control).

Experiments done utilizing the first methodology are illustrated in Tables 1 through 4 and experiments done utilizing the second methodology are illustrated in Tables 5 through 9.

A commercial product in the industry ("benchmark product") for decreasing photoyellowing, a synergistic mixture of "Benzotriazol" (2-(2H-benzotriazol-2-yl)-4,6-di-tert-pentylphenol, a UV-absorber) and "4-HydroxyTEMPO" (4-hydroxy-2,2,6,6-tetramethylpiperidineoxyl, a free radical), was compared with the application of aqueous solutions containing salts of thiocyanic acid.

TABLE 1

| Peroxide-bleached RMP (Midwest) | | | | | | |
|---|---|---|---|---|---|---|
| Chemical | Br0 | Ye0 | Br1 | Ye1 | BrLoss | % Inh |
| 0.1% Benzotriazol + 0.1% 4-HydroxyTEMPO | 76.96 | 13.25 | 75.12 | 14.09 | 1.84 | 39 |
| Sodium Thiocyanate 0.1% | 77.62 | 12.57 | 75.58 | 13.61 | 2.04 | 32 |
| Sodium Thiocyanate 0.2% | 77.35 | 12.84 | 75.65 | 13.69 | 1.71 | 44 |
| Control | 77.67 | 12.72 | 74.66 | 14.17 | 3.01 | |

The present invention will be further described in the following examples and tables. The examples are not intended to limit the invention prescribed by the appended claims.

Examples

A. Dry Paper Sheet Application/Surface Sizing Stage

Two methodologies were utilized to illustrate the application of chemicals at the surface sizing stage of the papermaking process. One methodology involved fixing a sample dry paper sheet on a glass surface with Scotch tape, placing the test solution on the upper Scotch tape as a line and then drawing it down with an application rod. The other methodology involved the preparation of a warm (60° C.) model sizing solution, normally with starch and optionally other sizing ingredients. The sample dry paper sheet is soaked in this solution for 10 seconds and then passed through a press to remove an excess of the solution.

Table 1 shows that, at the same dose, the use of sodium thiocyanate performs as well as a benchmark product. Moreover, this thiocyanate provides better initial brightness and brightness of the samples after the exposure is higher than that of the benchmark product, even at a lower dose.

TABLE 2

| Peroxide-bleached RMP (Midwest) | | | | | | |
|---|---|---|---|---|---|---|
| Chemical | Br0 | Ye0 | Br1 | Ye1 | BrLoss | % Inh |
| Sodium Thiocyanate 0.1% | 74.79 | 13.63 | 73.88 | 14.91 | 0.91 | 36 |
| Calcium Thiocyanate 0.1% | 74.84 | 13.74 | 73.86 | 15.06 | 0.98 | 32 |

Table 2 shows that the effect of thiocyanates is not significantly dependent on the cation.

TABLE 3

| Peroxide-bleached TMP (North Europe) | | | | | | |
|---|---|---|---|---|---|---|
| Chemical | Br0 | Ye0 | Br1 | Ye1 | BrLoss | % Inh |
| 0.1% Benzotriazol + 0.1% 4-HydroxyTEMPO | 66.5 | 21.2 | 63.24 | 22.56 | 3.23 | 20 |
| Sodium Thiocyanate 0.2% | 66.7 | 21 | 63.57 | 22.45 | 3.15 | 22 |
| Sodium Thiocyanate 0.1% | 66.8 | 21.2 | 63.2 | 22.13 | 3.62 | 10 |
| DTMPA* 0.1% + Sodium Thiocyanate 0.2% | 67.5 | 20.5 | 64.62 | 21.34 | 2.85 | 29 |
| Guanidine Thiocyanate 0.1% | 65.2 | 22.4 | 62.62 | 23.36 | 2.62 | 35 |
| Guanidine Thiocyanate 0.05% | 65.3 | 22.3 | 62.23 | 23.38 | 3.03 | 25 |
| Control | 67.2 | 20.6 | 63.13 | 22.52 | 4.04 | |

*40%, neutralized to pH 6.

Table 3 shows that the effect of thiocyanates can be improved when the chemical is combined with a chelant (e.g., DTMPA) in a single formulation. Using organic cations does not decrease protective properties but, in some cases (not always), may result in decreased initial brightness (this can be compensated by other means).

TABLE 4

| Peroxide-bleached TMP (Midwest) | | | | | | |
|---|---|---|---|---|---|---|
| Chemical | Br0 | Ye0 | Br1 | Ye1 | BrLoss | % Inh |
| 0.1% Benzotriazol + 0.1% 4-HydroxyTEMPO | 66.53 | 9.58 | 65.42 | 13.26 | 1.11 | 43 |
| Sodium Thiocyanate 0.1% | 66.68 | 9.66 | 65.92 | 13.14 | 0.76 | 61 |
| Sodium Thiocyanate 0.2% | 66.48 | 9.71 | 65.93 | 13.03 | 0.55 | 72 |

Table 4 shows that in the case of relatively low-level exposure to light, the brightness preservation effect can be very significant, exceeding current chemistries used in the industry.

TABLE 5

| Soaking application in 6% starch, peroxide-bleached TMP (Central Canada) | | | | | | |
|---|---|---|---|---|---|---|
| Chemical | Br0 | Ye0 | Br1 | Ye1 | BrLoss | % Inh |
| Sodium Thiocyanate 0.2% | 75.90 | 13.19 | 74.14 | 14.51 | 1.76 | 40 |
| Sodium Thiocyanate 0.1% | 75.86 | 13.24 | 74.09 | 14.41 | 1.78 | 39 |
| Ammonium Thiocyanate 0.2% | 76.6 | 12.71 | 75.32 | 13.67 | 1.28 | 56 |
| Ammonium Thiocyanate 0.1% | 76.42 | 12.79 | 74.70 | 13.95 | 1.72 | 42 |
| Di-n-butyl phthalate 0.2% | 76.90 | 12.72 | 74.34 | 14.28 | 2.55 | 13 |

Table 5 shows that ammonium thiocyanate is more efficient than sodium thiocyanate in this example. When ammonium thiocyanate is used, both initial brightness and photoyellowing protection are higher. For comparison, the data are presented for known UV-light-absorber-type protector.

TABLE 6

| Soaking application in 6% starch, peroxide-bleached TMP (Central Canada) | | | | |
|---|---|---|---|---|
| Chemical | Br0 | Br1 | BrLoss | % Inh1 |
| 0.2% Optical brightener | 79.14 | 76.04 | 3.37 | |
| 0.2% Optical brightener + 0.1% ammonium thiocyanate | 79.44 | 76.82 | 2.62 | 22 |

TABLE 6-continued

| Soaking application in 6% starch, peroxide-bleached TMP (Central Canada) | | | | |
|---|---|---|---|---|
| Chemical | Br0 | Br1 | BrLoss | % Inh1 |
| 0.2% Optical brightener + 0.2% Ammonium thiocyanate | 79.89 | 77.60 | 2.29 | 32 |

Table 6 shows that the proposed chemistry is effective also in presence of an optical brightener. The Optical brightener in this table is a stilbene fluorescent whitening agent, Tinopal ABP-A (Ciba Specialty, Tarrytown, N.Y.).

TABLE 7

| Soaking application in 6% starch, peroxide-bleached TMP (Central Canada); photoyellowing | | | | | | |
|---|---|---|---|---|---|---|
| Chemical | Br0 | Ye0 | Br1 | Ye1 | BrLoss | % Inh |
| Starch only | 75.55 | 13.37 | 72.17 | 15.45 | 3.37 | |
| Ammonium Thiocyanate 0.1% + EDTA* 0.05% | 75.66 | 13.08 | 73.28 | 14.57 | 2.35 | 30 |
| Ammonium Thiocyanate 0.1% + DTPA* 0.05% | 75.69 | 12.95 | 73.51 | 14.30 | 2.18 | 35 |
| Ammonium Thiocyanate 0.1% + DTMPA* 0.05% | 75.51 | 13.04 | 73.35 | 14.41 | 2.16 | 36 |

*40%, neutralized to pH 6.

Table 7 shows an example of combining ammonium thiocyanate with different chelants.

TABLE 8

| Soaking application in 6% starch, peroxide-bleached RMP (Midwest) and bleached softwood kraft (Midwest) RMP compositions | | | | | | |
|---|---|---|---|---|---|---|
| Chemical | Br0 | Ye0 | Br1 | Ye1 | BrLoss | % Inh |
| 100% RMP | 74.11 | 14.03 | 72.15 | 16.17 | 1.96 | |
| 90% Kraft/10% RMP | 79.91 | 8.62 | 79.30 | 10.05 | 0.61 | |
| 80% Kraft/20% RMP | 79.26 | 9.26 | 77.56 | 11.43 | 1.70 | |
| 70% Kraft/30% RMP | 78.57 | 9.91 | 76.69 | 12.27 | 1.88 | |
| Ammonium Thiocyanate 0.1% + DTPA 0.01% (100% RMP) | 74.25 | 13.79 | 73.13 | 15.12 | 1.12 | 43 |
| Ammonium Thiocyanate 0.1% + DTPA 0.01% (90% Kraft/10% RMP) | 79.93 | 8.37 | 79.80 | 9.44 | 0.13 | 75 |
| Ammonium Thiocyanate 0.1% + DTPA 0.01% (80% Kraft/20% RMP) | 79.39 | 9.10 | 78.80 | 10.38 | 0.59 | 65 |
| Ammonium Thiocyanate 0.1% + DTPA 0.01% (70% Kraft/30% RMP) | 78.76 | 9.78 | 77.60 | 11.34 | 1.16 | 35 |
| Ammonium Thiocyanate 0.2% + DTPA 0.01% (80% Kraft/20% RMP) | 79.35 | 8.99 | 78.87 | 10.42 | 0.48 | 72 |
| Ammonium Thiocyanate 0.2% + DTPA 0.01% (70% Kraft/30% RMP) | 78.75 | 9.81 | 77.86 | 11.10 | 0.89 | 50 |

Table 8 shows that thiocyanate increases stability towards photoyellowing of kraft-mechanical compositions, thus allowing the less expensive compositions that contain more mechanical pulp retain the properties of more expensive, higher-kraft compositions.

TABLE 9

| Soaking application in 3% starch, peroxide-bleached TMP (Midwest) | | | | | | |
|---|---|---|---|---|---|---|
| chemical composition | Br0 | Ye0 | Br1 | Ye1 | BrLoss | % Inh |
| 0.1% Benzotriazol | 79.17 | 12.13 | 76.44 | 13.33 | 2.67 | 14 |
| 0.2% Benzotriazol | 78.82 | 12.51 | 76.32 | 13.44 | 2.50 | 21 |
| 0.1% Ammonium Thiocyanate | 79.42 | 11.56 | 77.04 | 12.75 | 2.38 | 25 |
| 0.1% UV Screen + 0.1% Ammonium Thiocyanate | 79.20 | 11.68 | 77.27 | 12.60 | 1.93 | 39 |
| 0.1% UV Screen + 0.1% Ammonium Thiocayanate | 79.27 | 11.76 | 77.57 | 12.46 | 1.70 | 46 |
| 0.2% Ammonium Thiocyanate | 79.49 | 11.31 | 77.57 | 12.52 | 1.92 | 40 |
| 0.1% UV Screen + 0.2% Ammonium Thiocyanate | 79.52 | 11.41 | 77.90 | 12.15 | 1.62 | 49 |
| 0.2% UV Screen + 0.2% Ammonium Thiocyanate | 79.37 | 11.48 | 78.10 | 12.12 | 1.27 | 60 |
| Control | 79.29 | 11.74 | 76.12 | 13.55 | 3.16 | |

Table 9 shows that combining thiocyanates with UV (light) absorbers leads to a significant increase in brightness protection against photoyellowing.

B. Wet Sheet Application

One methodology (wet end sheet application) was utilized to illustrate the application of chemicals on a wet sheet of a papermaking process. This methodology involved fixing a wet sheet after formation, pressed (consistency 30-40%) but not yet exposed to the drum drier, on a glass surface with Scotch tape, placing the test solution on the upper Scotch tape as a line and then drawing it down with an application rod.

After applying the chemical(s) by this methodology, the test sheets were dried in a drum drier (1 cycle, 100° C.) and equilibrated at constant humidity 50% and 23° C. The brightness was measured and then the sheets were exposed to "cool white" light on a rotating carousel at room temperature. An LZC-1 Photoreactor (LuzChem Research, St. Sauveur, QC, Canada) was used in the experiments. The samples were again equilibrated and brightness measured (R457 brightness, E313 yellowness, Elrepho-3000 instrument, Datacolor International, Charlotte, N.C.).

The doses in the following tables are calculated based on o.d. pulp and a product containing 40% active thiocyanates. For the interpretation of these tables, the following legend should be utilized: Br0—initial brightness, Ye0—initial yellowness, Br1—brightness after exposure, Ye1—yellowness after exposure, brightness loss BrLoss=Br0−Br1, inhibition %Inh=100*[BrLoss(control)−BrLoss(sample)]/BrLoss(control).

Experiments done utilizing this methodology are illustrated in Tables 10 through 11. Tables 10 and 11 show examples of two thiocyanates applied on a wet sheet before a dryer. In both cases, brightness protection is observed.

TABLE 10

| Peroxide-bleached TMP (Central Canada) | | | | | | | |
|---|---|---|---|---|---|---|---|
| Chemical | Br0 | Ye0 | Gain | Br1 | Ye1 | BrLoss | % Inh |
| Ammonium Thiocyanate 0.1% | 75.70 | 13.15 | 0.03 | 73.01 | 14.99 | 2.69 | 17 |
| Ammonium Thiocyanate 0.2% | 75.78 | 12.75 | 0.11 | 73.70 | 14.39 | 2.08 | 36 |
| Control | 75.67 | 13.05 | | 72.43 | 15.38 | 3.24 | |

TABLE 11

| Peroxide-bleached TMP (Central Canada) | | | |
|---|---|---|---|
| Chemical | Br0 | Br1 | BrLoss |
| Control | 76.6 | 72.3 | 4.3 |
| Sodium Thiocyanate 0.2% | 75.7 | 72.6 | 3.1 |
| Sodium Thiocyanate 0.1% | 76.1 | 72.9 | 3.2 |

We claim:

1. A method of decreasing the rate of photoyellowing in lignin containing paper containing mechanical pulp comprising: applying an aqueous solution containing an effective amount of one or more salts of thiocyanic acid on the surface of a paper sheet in a papermaking process wherein the pH range of said solution is from 6 to 7.

2. The method of claim 1, wherein the solution excludes UV absorbers and the solution decreases the rate of photoyellowing more than a synergistic combination of a 4-hydroxy-2,2,6,6-tetramethylpiperidineoxyl free radical combined with a benzotriazol UV absorber would, when the thiocyanic acid is applied at a lower dosage than the synergistic combination.

3. The method of claim 1, wherein the cation of said salts are organic cations.

4. The method of claim 1, wherein said aqueous solution is applied to a paper sheet by applying said aqueous solution to a sizing solution at a surface sizing stage of said papermaking process.

5. The method of claim 1, wherein said aqueous solution is applied to a paper sheet by applying said aqueous solution in or after the press section of said papermaking process.

6. The method of claim 1, wherein said aqueous solution is applied to a paper sheet by applying said aqueous solution is added to the surface of a partly dewatered sheet in a papermaking process before it hits a first drum dryer.

7. The method of claim 1, wherein said salts are selected from the group consisting of: inorganic thiocyanates; sodium thiocyanate; potassium thiocyanate; ammonium thiocyanate; and calcium thiocyanate.

8. The method of claim 1 further comprising the addition of either separately or as a mixture with said aqueous solution, an effective amount of chemicals selected from the group consisting of: chelants; optical brighteners; fluorescent dyes; and a combination thereof.

9. The method of claim 8, wherein said effective amount of chemicals is 0.004 to 2 weight percent oven dried pulp.

10. The method of claim 8, wherein said chelants are selected from the group consisting of: EDTA; DTPA; and DTMPA.

11. The method of claim 8, wherein said optical brighteners are selected from the group consisting of: substituted stilbenedi-, tetra- and hexasulfonic acids; triazynilaminostilbene acids; dicyano-1,4-bis-styrylbenzenes, bisbenzoxazoles, bis(triazynilamino)stilbenes; sulfonated fused polyaromatic (polynuclear) compounds; and distilbenes.

12. The method of claim 8, wherein said aqueous solution is mixed with said chelant in a ratio from 1:100 to 100:1 on the base of active solids.

13. The method of claim 8, wherein said aqueous solution is mixed with said UV absorbers in a ratio from 1:100 to 100:1 on the base of active solids.

14. The method of claim 1, wherein said aqueous solution is around 10% to around 60% aqueous solution of an active material comprising sodium thiocyanate or ammonium thiocyanate or a mixture of said sodium thiocyanate or said ammonium thiocyanate with a chelant selected from the group consisting of: DTPA; EDTA; and DTMPA in a ratio from around 1:100 to around 100:1.

15. The method of claim 1, wherein said aqueous solution is applied to a wet paper sheet.

16. The method of claim 1, wherein said aqueous solution is applied to a dry paper sheet.

17. The method of claim 1, wherein the cation of said salts are inorganic cations.

18. The method of claim 1 wherein the aqueous solution is applied to the surface of the paper sheet at a surface sizing stage of the papermaking process.

19. The method of claim 1 in which the resulting paper has a photoyellowing inhibition of at least 22%.

* * * * *